United States Patent [19]

Chang

[11] 4,428,309

[45] Jan. 31, 1984

[54] PULVERIZED-COAL AND LIQUID-FUEL DUAL-PURPOSE BURNER

[76] Inventor: Shien-Fanh Chang, 55, Chung Cheng Rd., Hsin Yin Chen, Tainan Hsien, Taiwan

[21] Appl. No.: 501,547

[22] Filed: Jun. 9, 1983

Related U.S. Application Data

[63] Continuation of Ser. No. 310,400, Oct. 9, 1981, abandoned.

[51] Int. Cl.[3] ..... F23C 1/10; F23Q 9/00

[52] U.S. Cl. ..... 110/262; 110/261; 110/264; 110/265; 110/347; 431/284

[58] Field of Search ..... 110/260–265, 110/297, 347; 431/284

[56] References Cited

U.S. PATENT DOCUMENTS

| | | | |
|---|---|---|---|
| 657,579 | 9/1900 | White | 110/262 |
| 706,495 | 8/1902 | Reed | 110/261 |
| 1,468,008 | 9/1923 | Dyson | 110/261 |
| 1,476,994 | 12/1923 | Meyer et al. | 110/261 |
| 1,661,031 | 2/1928 | Butcher | 110/261 |
| 1,726,870 | 9/1929 | Trent | 110/261 |
| 2,044,296 | 6/1936 | Hardgrove | 431/284 |
| 2,531,316 | 11/1950 | Zink | 431/284 |
| 3,147,795 | 9/1964 | Livingston et al. | 431/284 |
| 3,822,654 | 7/1974 | Ghelfi | 110/260 |
| 4,096,808 | 6/1978 | Trickel | 110/244 |
| 4,208,180 | 6/1980 | Nakayasu et al. | 431/284 |

FOREIGN PATENT DOCUMENTS

| | | | |
|---|---|---|---|
| 2905746 | 8/1980 | Fed. Rep. of Germany | 110/262 |
| 323578 | 1/1930 | United Kingdom | 110/261 |
| 650833 | 3/1951 | United Kingdom | 110/261 |
| 704901 | 3/1954 | United Kingdom | 110/262 |

*Primary Examiner*—Henry C. Yuen

*Attorney, Agent, or Firm*—Burns, Doane, Swecker & Mathis

[57] ABSTRACT

A dual-purpose burner capable of utilizing either pulverized coal or liquid fuels such as heavy oil as alternate fuels, or both simultaneously, and if desired, utilizing the mixture of pulverized coal and steam or water and atomizing it to achieve a high combustion efficiency and the prevention of atmospheric pollution. The burner consists of a main body constructed of triple pipes and a screw conveyor disposed in the rear part of the main body. The main body contains primary and secondary air inlets and a port for the passage of liquid fuels or steam.

4 Claims, 4 Drawing Figures

PULVERIZED-COAL AND LIQUID-FUEL DUAL-PURPOSE BURNER

This application is a continuation, of application Ser. No. 06/310,400, filed Oct. 9, 1981 now abandoned.

BACKGROUND OF THE INVENTION

The present invention is concerned with burners for furnaces, and more particularly with a dual-purpose burner capable of utilizing either pulverized coal or liquid fuels such as heavy oil, or both simultaneously, and if desired, utilizing the mixture of pulverized coal and steam or water and atomizing it to achieve a high combustion efficiency and the prevention of atmospheric pollution.

Many types of pulverized-coal burners utilize pulverized coal as a fuel and inject the mixture of pulverized coal and primary and secondary air into a furnace for combustion, such as the renowned U.S. B & W multiple-intertube multitip pulverized-coal burner, cross-tube pulverized-coal burner and circular burner. Another type of burner utilizes liquid fuels such as heavy oil, or utilizes gas and air mixture, and injects the atomized fuel into a furnace for combustion (known as a liquid-fuel burner and gas burner respectively). These burners have been used extensively for industrial boilers. However, thus far there has never been a burner like that of the present invention having a combination of the above-mentioned functions. On the other hand, because of a world-wide energy crisis resulting in the increase in price and in a cutback in the production of petroleum, the problems of the ever-fluctuating prices and sources of supply often must be taken into consideration in the selection of fuels, liquid as oil or solid as pulverized coal, or even a combination of both, to ensure low operating cost and uninterrupted supply of fuels. Therefore, if selection anticipates, for example, pulverized coal, then an existing liquid-fuel burner must be replaced by a pulverized-coal burner or altered to burn pulverized coal, and vice versa, depending on the fuel selected. This is not only inconvenient but costly.

It is known that in pulverized-coal burners the air supplied by a blower is partially mixed with pulverized coal and acts as a conveyor therefor. However, if the mixing of pulverized coal with air is effected by means of a turbulence, pulverized coal particles tend to be thrown by centrifugal force to the inner wall surface, particularly the outlet, of the burner pipe, and adhere thereto. Thus, after a certain period of time the passage of mixed fuel into a furnace is blocked causing more energy consumption because a blower of higher power must be used to supply more excess air in forcing the mixed fuel into the furnace. Moreover, since complete combustion of the mixed fuel can not be achieved under such circumstances, more soot and ash are produced with increasing unburned combustible loss, which in turn will bring about the problem of air pollution and a waste of energy.

OBJECTS AND SUMMARY OF THE INVENTION

Thus the present invention is aimed to overcome or substantially ameliorate the above disadvantages.

The primary object of the present invention is to provide a dual-purpose burner capable of burning either pulverized coal or liquid fuels such as heavy oil as well as mixing and atomizing both types of fuels to achieve a high combustion efficiency.

Another object of the present invention is to provide a pulverized-coal and liquid-fuel dual-purpose burner which is adapted to mix pulverized coal with steam or water for combustion.

Still another object of the present invention is to provide a pulverized-coal and liquid-fuel dual-purpose burner which is effective in preventing burner pipe pluggage by pulverized coal particles to ensure smooth passage of fuels into a furnace.

A further object of the present invention is to provide a pulverized-coal and liquid-fuel dual-purpose burner comprising a main body which is constructed of triple pipes, a screw conveyor disposed in the rear part of the main body, and primary and secondary air ducts in communication with the lower portion of the main body, that is, a burner of a simple construction conducive to operation and maintenance and yet well suited for various types of boilers and kilns.

Still a further object of the present invention is to provide a dual-purpose burner having an oil injecting pipe supported by a tubular bolt which also acts as a liquid-fuel inlet pipe.

These and other objects, features and advantages of the invention will become more apparent from a consideration of the following description taken in connection with the accompanying drawings.

DESCRIPTION OF PREFERRED EMBODIMENTS

Figure 1:
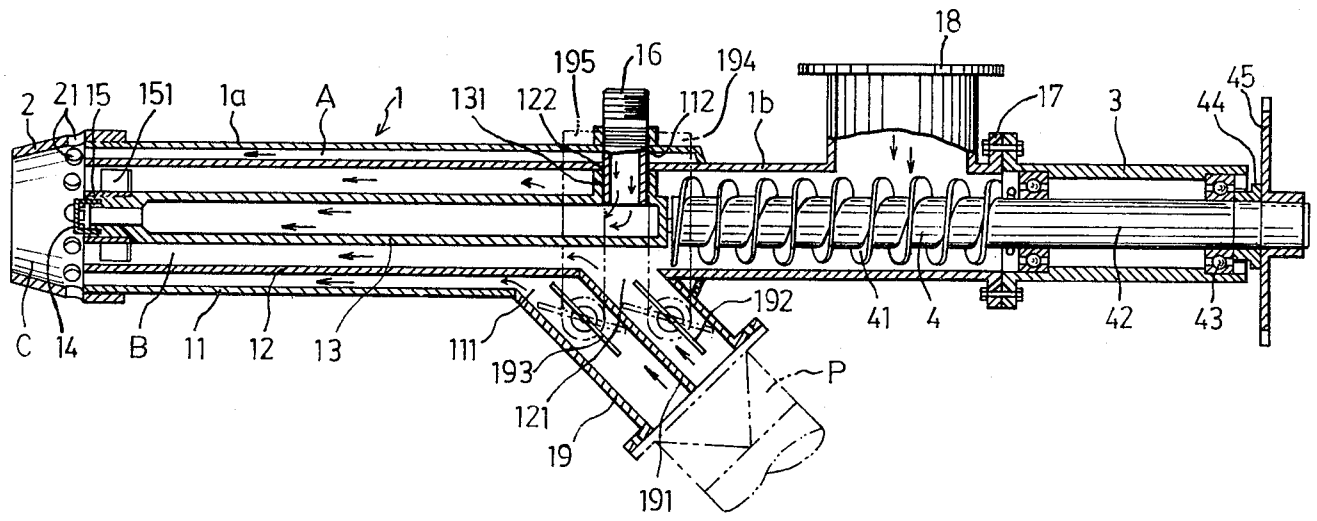
FIG. 1 is a partial cross-sectional side view of a dual-purpose burner according to the present invention.
Figure 2:
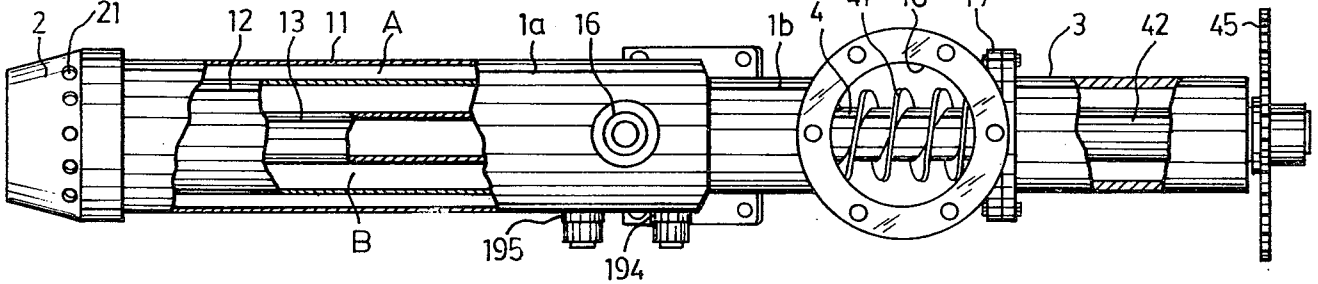
FIG. 2 is a partial cross-sectional top view of a dual-purpose burner according to the present invention.

As seen from FIGS. 1 and 2, the dual-purpose burner of the invention comprises a main body 1 which includes a front member 1*a* constructed of three pipes 11, 12, 13 and a rear member 1*b* constructed of a single pipe; a flame spout 2 which is detachably attached to the front end of the front member 1*a;* a supporting sleeve 3 which is connected to the rear member 1*b;* and a screw 4 which is rotatably interposed within the sleeve 3 and the rear member 1*b*.

Figure 3:
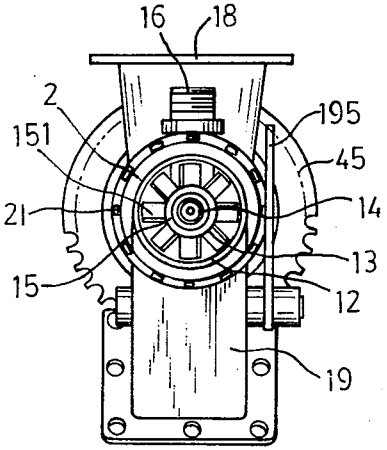
FIG. 3 is a partial cross-sectional front view of a dual-purpose burner according to the present invention.

The front member 1*a* consists of three pipes disposed concentrically in the order of an outer pipe 11, an intermediate pipe 12 and an inner pipe 13. The outer pipe 11 serves as a secondary-air duct having a secondary-air inlet 111 in its rear lower portion and a screw hole 112 in its rear upper portion. The outer pipe is joined by welding at its rear portion to the outer periphery of the rear end of the intermediate pipe 12, which is thus held in suspension within the outer pipe. The intermediate pipe, actually formed integrally with the rear member 1*b*, serves to direct primary air from a primary-air inlet 121 adjacent to the secondary-air inlet 111 so that pulverized coal is conveyed to the front end of the main body. A screw hole 122 having a diameter exactly the same as that of the hole 112 is formed in the rear upper portion of the intermediate pipe. The space defined between the outer pipe 11 and the intermediate pipe 12 forms an annular passage A, through which passes the secondary air. The inner pipe 13 through which liquid fuels or steam pass is arranged in the center of the pipe 12, with its rear end sealed and front end fitted with a nozzle 14 for atomization and injection of liquid fuels or steam in the form of a turbulence. Detachably fixed to the outer periphery of the front end of the pipe 13 is a turbulence generating assembly 15 having a plurality of curved blades 151 for making a turbulence out of the pulverized-coal-laden primary-air stream, as can be seen clearly in FIG. 3. On the rear upper portion of the pipe 13 there is further provided an upwardly projecting sleeve nut 131 which abuts against the inner wall edge of the pipe 12 and which is disposed into alignment with said screw holes 112 and 122 such that a threaded liquid-fuel inlet pipe 16 shaped like a tubular bolt can be inserted through said screw holes 112 and 122 and fitted into the sleeve nut to hold the inner pipe 13 in suspension within the intermediate pipe 12. The space defined between the pipes 13 and 12 forms an annular passage B, through which pulverized coal and primary air pass.

Figure 4:
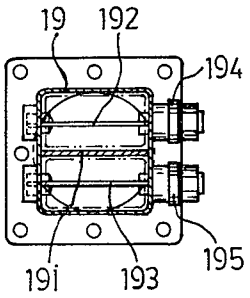
FIG. 4 is a partial cross-sectional view of the air inlet pipe shown in FIG. 1.

The rear member 1*b* of the main body 1 as described earlier is formed integrally with the intermediate pipe 12. A flange 17 extends around the outer periphery of the rear end of the rear member, and an upwardly projecting pulverized-coal port 18 is located on the rear portion thereof. Under the rear portion of the front member there is an air inlet pipe 19 encompassing both the primary-air inlet 111 and secondary-air inlet 121 and extending downwardly and backwardly. It is preferred that the air inlet pipe 19 be inclined so that an angle of around 135° is defined between the front member and the pipe 19 and that the pipe 19 be of a rectangular shape. By means of a partition wall 191 the pipe 19 is divided into two air ducts, one leading to the primary-air inlet, and one to the secondary-air inlet. A blowpipe P is joined at one end to the bottom end of the pipe 19 so that wind is blown into the pipe 19 by a blower which is not shown herein. As seen clearly in FIG. 4, in order to control the volume of air to be directed into the burner pipes from the blower, a primary-air regulating valve 192 and a secondary-air regulating valve 193, both adjustable through a pair of handles 194 and 195, are assembled respectively within the two air ducts in the pipe 19.

To the front end of the main body is joined a flame spout 2 which tapers off in diameter toward the discharge end and which has a plurality of air holes 21 disposed in the peripheral wall near the juncture. The interior of the flame spout forms a mixing chamber C wherein the liquid fuel or steam or water injected from the nozzle 14, and/or the mixture of pulverized coal and primary air from the pipe 12, is mixed with secondary air from the outer pipe 11.

Turning now to FIG. 1, there is illustrated a two-part screw 4. The front half of the screw 4 has a series of helical blades 41, while the rear half is a driven shaft 42 whereby the screw 4 is supported by means of two bearings 43 and is rotatably received within the supporting sleeve 3 and the rear member 1*b*. The rear member and the screw 4 received therein combine to form a screw conveyor. The shaft 42 extends beyond the rear end of the supporting sleeve 3 into a spacer sleeve 44 so as to be in engagement with a sprocket wheel 45, and the front end of the screw 4 is spaced from the sealed end of the inner pipe 13 at an extremely short interval.

The steps to be followed in operating the burner of the invention include:

1. connecting the liquid-fuel inlet pipe 16 with a pipe (not shown in the accompanying drawings) for delivery of liquid fuels or steam or water, the supply of any of which can be controlled by adjusting a valve (not shown) and by a liquid-fuel pump (not shown);
2. connecting the blowpipe P with a blower (not shown) for supply of air;
3. mounting a pulverized-coal feeder (not shown) on the pulverized-coal port 18;
4. connecting the sprocket wheel 45 with a variable-speed motor (not shown) by means of a drive chain (not shown);
5. preparing the burner for operation by keeping the air regulating valves 192 and 193 in open position by means of the handles 194 and 195;
6. actuating the blower and liquid-fuel pump so as to convey the air and the selected liquid fuel through the air inlets 111 and 121 and the liquid-fuel inlet pipe 16, respectively, and into the annular passages A and B and the inner pipe 13, the liquid fuel being injected by the nozzle 14 into the mixing chamber C, wherein atomization of the liquid fuel and primary and secondary air takes place and injection of the atomized mixture into a furnace (not shown) is done by the flame spout 2 while at the same time ignition of the mixture is completed by a lighter (not shown); and
7. when the temperature in the furnace has risen to be high enough for combustion of pulverized coal, for example, over 600° C., cutting off the supply of liquid fuel, and supplying the burner with pulverized coal instead by starting the motor which drives the screw 4 through the drive chain, sprocket wheel 45 and driven shaft 42 so that pulverized coal from the port 18 is conveyed through the rear member and then blown into the annular passage B by primary air from the air inlet 121.

At this stage, the pulverized-coal-laden primary-air stream, under the influence of the curved blades 151, is converted into a turbulence bursting into the mixing chamber C, wherein the turbulence, secondary air which comes from the secondary-air inlet 111 via the annular passage A, and steam or water injected by the nozzle 14 are all mixed together and atomized. The atomized mixture is immediately ignited by the flames in the furnace and then spurted into the furnace by the flame spout 2. The condition of combustion in the furnace can be controlled by both altering the rate of speed at which the screw 4 rotates to regulate the amount of pulverized coal to be conveyed and adjusting the air regulating valves 192 and 193 to regulate the volume of primary and secondary air so as to ensure complete combustion.

In this invention, the air blown from the air inlet 121 into the intermediate pipe 12 provides pulverized coal with primary air so as to accomplish the primary mixing of pulverized coal with primary air and the conveying of pulverized coal simultaneously. When reaching the front end of the pipe 12, the coal-air stream is converted into a turbulence under the influence of the curved blades 151 and bursts into the mixing chamber, wherein the secondary mixing takes place, i.e., the mixing of the turbulence with secondary air coming from the air inlet 111 via the outer pipe 11 and steam or water injected from the inner pipe 13. As air is fully supplied, the mixed fuel is kept in a readily combustible condition, and the flame is shot out into the furnace by means of forceful and swift secondary-air flow to cause flames in the furnace to spread uniformly so that the optimum condition of combustion can be expected.

In respect of the applications of fuels in the burner of the invention, the heretofore discussion involves merely the respective use of liquid fuels and the mixture of pulverized coal and steam or water. However, it has been found advantageous that liquid fuels are mixed with pulverized coal as a fuel for the burner.

In addition, it is known that the simplest means of mixing pulverized coal with primary air and of creating a turbulence thereby is to dispose the air inlet pipe 19 and the primary-air inlet into eccentricity with respect to the axis of the main body, that is, to introduce the air into the main body in the tangential manner. Nevertheless, a series of careful experiments conducted by the inventor have shown that this always gives rise to the plugging of the intermediate pipe because during their travel through the longer intermediate pipe, pulverized coal particles tend to be thrown by centrifugal force to the inner wall surface of the pipe and deposit thereon, thus causing the shrinkage of the annular passage B in width and the shortage of air flow. Since the use of a blower of higher power as a source of more excess air is necessary under such circumstances, higher energy consumption becomes inevitable; otherwise, the inadequate mixing of pulverized coal and air due to the lack of air flow will result in incomplete combustion and carbon contamination, while serious pipe pluggage will cause the burner to be inefficient in performance. It also has been found in the experiments that if curved blades are positioned in the rear or middle of the inner pipe so that the turbulence may take place earlier, the same problem as above arises. In this invention, therefore, the air inlet pipe 19 is disposed at an angle of around 135° relative to the axis of the main body and curved blades 151 are positioned in the output end of the inner pipe such that primary air from the air inlet 121 can blow and disperse the pulverized coal already conveyed to the front end of the screw 4 before it drops into the primary-air duct and then direct it straight forward smoothly and uninterruptedly within the intermediate pipe 12 without any centrifugal force causing the plugging of the pipe 12 by the deposit of pulverized coal particles. Although centrifugal force may come into being when the pulverized-coal-laden primary-air stream has been converted into a turbulence in the mixing chamber because of the induction of the curved blades, the forceful and swift secondary air flow which thrusts straight forward will not only carry forward the turbulence far into the furnace but also prevent pulverized coal particles thrown around by the centrifugal force from adhering to the inner wall surface of the flame spout, while extra air, attracted by the force of secondary air flow, will be sucked from without into the mixing chamber via the air holes 21 to help prevent the deposit of pulverized coal particles on the inner wall surface.

Therefore the burner described hereinbefore is well suited for either liquid fuels or pulverized coal, or both, and enables the user to select the desired fuel without the need to replace or alter his burner, this being convenient and economical. Another feature of the burner is that combustion efficiency is increased by the supply of primary air, which contributes to the substantial mixing of the fuel air, and by the supply of secondary air, which provides excess air for promoting the combustion of the fuel-air mixture and for carrying rapidly forward the flame of the mixture (which then is slow in progress as a turbulence) into collision with the inner wall of the furnace with such a force that it reverberates to cause uniform spread and prolonged lag of flames in the furnace. With due consideration to wide selectivity of fuels and high combustion efficiency, the burner of the invention provides such advantages as ease of construction, economy in operation, low power consumption and prevention of atmospheric pollution.

What is claimed is:

1. A pulverized-coal and liquid-fuel burner comprising:

a main body including:

a front member comprising an outer pipe, an intermediate pipe, and an inner pipe, said pipes being coaxially and telescopingly arranged, said outer pipe including a secondary-air inlet in a lower side thereof, and said intermediate pipe including a primary-air inlet located adjacent said secondary-air inlet and adjacent a rear end of said inner pipe, said outer, intermediate, and inner pipes including holes at their rear ends, which holes are aligned, a threaded liquid-fuel inlet pipe extending through said holes and projecting beyond said outer pipe, said liquid-fuel inlet pipe securing said inner pipe within said intermediate pipe, a discharge nozzle attached to a front end of said inner pipe, and a rear member formed integrally with said intermediate pipe and including a port disposed on an upper side of a rear end thereof for the reception of pulverized coal, a flame spout detachably secured to the front end of said main body and tapering-down in diameter toward its discharge end, said flame support including a peripheral wall having a plurality of holes therein spaced rearwardly from the discharge end of said flame spout, an air inlet pipe joined to said front member in encompassing relationship to said primary-air and secondary-air inlets for introducing air into said outer and intermediate pipes, said air inlet pipe being inclined toward said rear member so as to be disposed at an inclined angle relative to the axis of said front member, said air inlet pipe being divided into one primary air duct and one secondary air duct by a partition wall, both air ducts having an air regulating valve assembled therein, a supporting sleeve connected to a rear end of said rear member by removable fasteners, bearings mounted in front and rear ends of said supporting sleeve, a driven shaft mounted within said bearings so as to be aligned with said inner pipe, said shaft including a helical screw at a front end thereof to define a screw conveyor for conveying pulverized coal forwardly from said port, a front end of said screw thread terminating immediately adjacent said rear end of said inner pipe and said primary-air inlet and means for rotating said shaft.

2. A dual-purpose burner as in claim 1, wherein said inner pipe has a turbulence generating assembly detachably fixed to the outer periphery of said front end, said assembly having a plurality of radially extending curved blades for inducing said primary air to become a turbulence.

3. A dual-purpose burner as in claim 1, wherein the rear end of said outer pipe and the outer periphery of the front end of said rear member are welded together so that said pipe is integral with said intermediate pipe.

4. A dual purpose burner as in claim 1, wherein said air inlet pipe is inclined at an inclined angle of around 135° relative to the axis of said front member.

* * * * *